US010064522B2

(12) United States Patent
DeLau et al.

(10) Patent No.: US 10,064,522 B2
(45) Date of Patent: Sep. 4, 2018

(54) PORTABLE BATHTUB SAFETY DEVICE

(71) Applicants: Alan Lee DeLau, Hammond, IN (US); Bruce Edward DeLau, Marshfield, WI (US)

(72) Inventors: Alan Lee DeLau, Hammond, IN (US); Bruce Edward DeLau, Marshfield, WI (US)

( * ) Notice: Subject to any disclaimer, the term of this patent is extended or adjusted under 35 U.S.C. 154(b) by 210 days.

(21) Appl. No.: 15/195,522

(22) Filed: Jun. 28, 2016

(65) Prior Publication Data

US 2017/0367539 A1 Dec. 28, 2017
US 2018/0098668 A9 Apr. 12, 2018

Related U.S. Application Data

(60) Provisional application No. 62/187,314, filed on Jul. 1, 2015.

(51) Int. Cl.
*A47K 3/00* (2006.01)
*E04H 4/10* (2006.01)

(52) U.S. Cl.
CPC ..... *A47K 3/001* (2013.01); *E04H 4/103* (2013.01)

(58) Field of Classification Search
CPC .. A47K 3/001; E04H 4/06; E04H 4/10; E04H 4/103
USPC ..... 4/580
See application file for complete search history.

(56) References Cited

U.S. PATENT DOCUMENTS

| | | | | |
|---|---|---|---|---|
| 3,931,652 | A * | 1/1976 | Navarra | A47K 3/064 4/580 |
| 4,606,083 | A * | 8/1986 | Kingston | A47K 3/001 220/215 |
| 6,336,231 | B1 * | 1/2002 | Smith | A47K 3/001 4/573.1 |
| 8,627,980 | B2 * | 1/2014 | Woodruff | A47K 3/001 220/495.03 |
| 2006/0075548 | A1 * | 4/2006 | Kranson | A47K 3/002 4/580 |
| 2008/0000922 | A1 * | 1/2008 | Nevils | E03B 11/02 220/723 |

FOREIGN PATENT DOCUMENTS

| | | | | |
|---|---|---|---|---|
| WO | WO-8203002 | A1 * | 9/1982 | A47K 3/001 |

* cited by examiner

*Primary Examiner* — Ryan A Reis

(57) ABSTRACT

The portable bathtub safety device is a portable inflatable barrier system, that when correctly installed and maintained (fully inflated) should help prevent people from falling into most types of empty bathtubs. The device utilizes a separate barrier cushion over the edge of the tub that should lessen the chance of serious injury by acting as a protective cushion over the edge of the tub.

4 Claims, 3 Drawing Sheets

PORTABLE BATHTUB SAFETY DEVICE

BRIEF SUMMARY OF THE INVENTION

This patent is for a portable inflatable barrier system which when used properly and maintained (fully inflated) should help prevent people from falling into most types of an empty bathtub. This is especially useful for senior citizens who may lose their balance and fall into a empty tub.

DETAILED DESCRIPTION OF THE INVENTION

The device is composed of three main parts.

Figure 1:
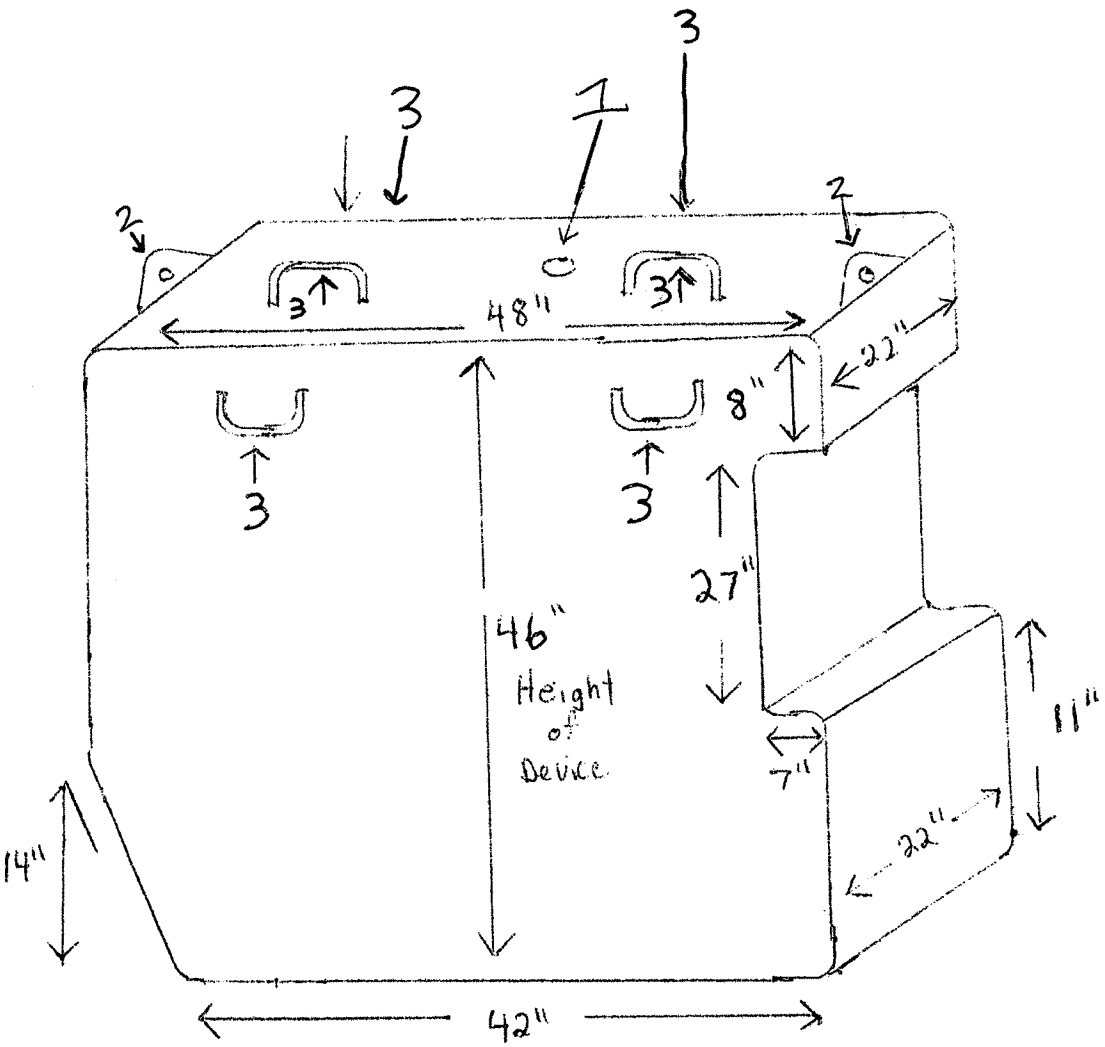
FIG. 1 shows a perspective view of a primary part of the device.

FIG. 1 shows the primary part of the device.

It is a inflatable unit of rubberized plastic, which when inflated using an inflation valve 1, sits in the bottom of the bathtub. This unit is approximately the size of most standard bath tubs. Because the plastic is rubberized, it will allow for some slight further inflation to accommodate most tub sizes with a snug fit. There is a recessed area on the side to allow for the bath tub water spout, drain control, and water adjustment handle or handles, so that they do not press into the plastic.

On the top of the unit are two plastic tabs 2, each with a stainless eyelet. These tabs 2 are situated at opposite ends of the device. The purpose of the tabs 2 is to allow a piece of cord to tie each end of the unit to a towel bar. Where a towel bar is not part of the bath tub environment, a suction cup will be provided to attach to the wall to secure the cord. The cord merely hold the device in the upright position. This unit will accommodate water spouts and controls on the left or right side of the tub. The drawing shows the unit with the recessed area set up for a tub with the faucet on the right side of the tub. If the faucet and controls are on the left side of the tub, just turn the unit around so that the recessed area is on the left side of the tub.

Two lifting handles 3 are provided on the top of the unit, and two lifting handles 3 on each side of the unit. These handles 3 will help facilitate the inflated unit to be quickly lifted out and removed from the tub, and also reinstalled while still inflated.

Figure 2:
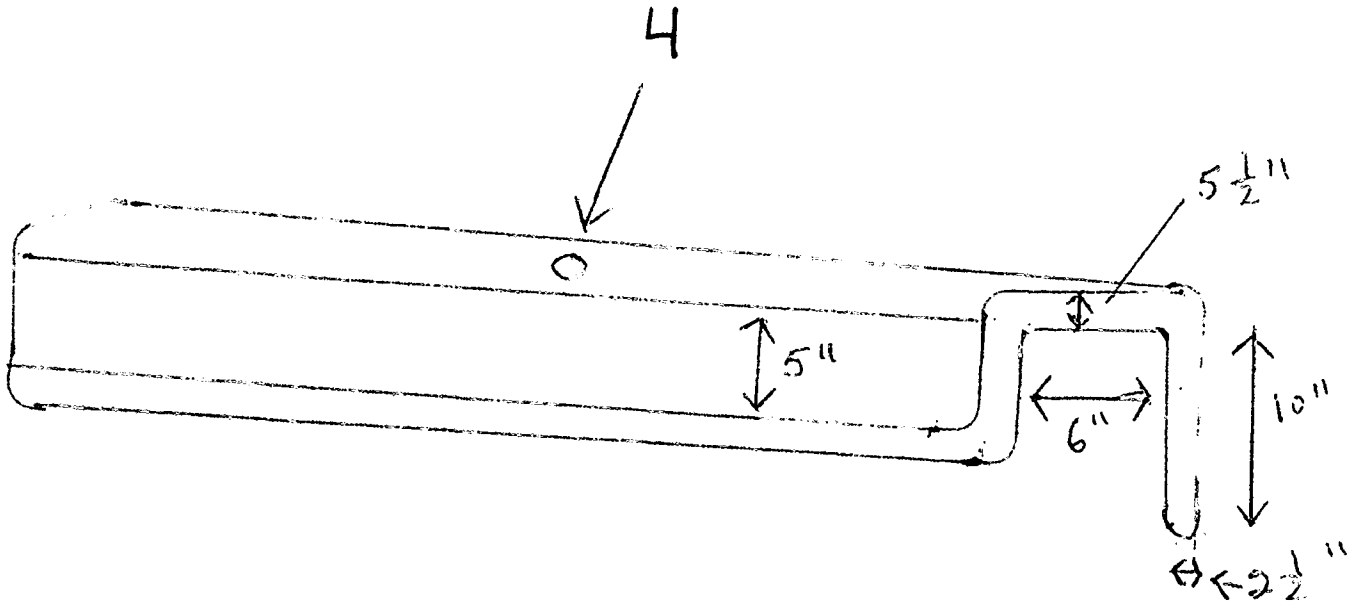
FIG. 2 shows a perspective view of a second part of the device.

FIG. 2 shows the second part of the device. It is a sleeve made of rubberized plastic, which is inflated by an inflation valve 4 and fits over the edge of the tub.

This serves a two fold purpose. It will provide a cushion on the edge of the tub that should lessen the chance of a serious injury by acting as a cushion over a hard surface. The second purpose is to help the main unit of FIG. 1 to fit snugly in the tub.

Figure 3:
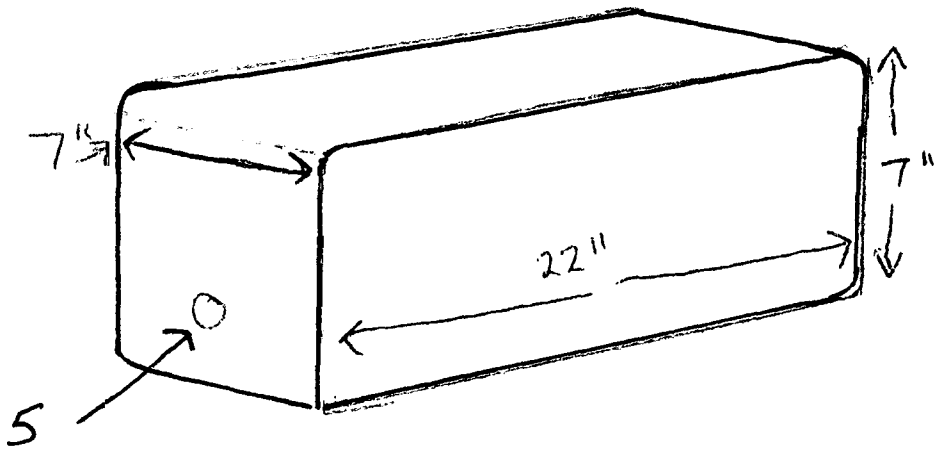
FIG. 3 shows a perspective view of a third part of the device.

FIG. 3 shows what is the third part of the device. It is essentially an inflatable pillow of rubberized plastic. This pillow helps fill in the gap between the water spout and the water faucet itself. This also helps to further secure the main unit in drawing "A" with a snug fit.

An additional "pillow" is available if needed, to further to further fill any empty spaces in the recessed area.

The third part of the device is inflated using an inflation valve 5. These units can be inflated with most off the shelf manual or electric air pumps.

We claim:

1. A portable bathtub safety device, comprising:

a first inflatable unit having a top portion, a bottom portion, and four sides;

an inflation valve on the top portion;

a recessed portion on one of the four sides;

two tabs on the top portion, wherein each tab has an eyelet; and at least one lifting handle on the top portion or on one of the four sides, wherein the first inflatable unit occupies the empty space of a bathtub when inflated within the bathtub.

2. The portable bathtub safety device of claim 1, further comprising a second inflatable unit, wherein the second inflatable unit covers an edge of the bathtub.

3. The portable bathtub safety device of claim 2, further comprising a third inflatable unit, wherein the third inflatable unit is installed in the recessed portion of the first inflatable unit.

4. The portable bathtub safety device of claim 3, wherein the first inflatable unit, the second inflatable unit, and the third inflatable unit are made from rubberized plastic.

* * * * *